US006004048A

United States Patent [19]

Moh et al.

[11] Patent Number: 6,004,048

[45] Date of Patent: Dec. 21, 1999

[54] APPARATUS AND METHOD FOR ENSURING GOOD PRINT QUALITY IN A MAIL HANDLING SYSTEM INCLUDING A FIXED PRINTHEAD/MOVING MAILPIECE SUBSYSTEM

[75] Inventors: Sungwon Moh, Wilton; Arno Muller, Westport, both of Conn.; Eswaran C. N. Nambudiri, Ryebrook, N.Y.; Mark A. Scribe, Southbury, Conn.

[73] Assignee: Pitney Bowes Inc., Stamford, Conn.

[21] Appl. No.: 09/080,616

[22] Filed: May 18, 1998

[51] Int. Cl.[6] ..... B41J 3/407

[52] U.S. Cl. ..... 400/70; 705/405

[58] Field of Search ..... 705/401, 405, 705/408, 410; 395/115, 116; 400/62, 70, 76

[56] References Cited

U.S. PATENT DOCUMENTS

| | | | |
|---|---|---|---|
| 4,706,215 | 11/1987 | Kirschner et al. | 364/900 |
| 4,807,141 | 2/1989 | Muller | 364/464.02 |
| 5,509,117 | 4/1996 | Haug | 395/182.08 |
| 5,608,636 | 3/1997 | Guenther | 364/464 |
| 5,651,103 | 7/1997 | Arsenault et al. | 395/117 |
| 5,740,728 | 4/1998 | DeBarber et al. | 101/93 |
| 5,758,330 | 5/1998 | Brown | 705/405 |

*Primary Examiner*—John Hilten

*Attorney, Agent, or Firm*—Steven J. Shapiro; Michael E. Melton

[57] ABSTRACT

A mail handling system includes a printhead for printing a postage indicium on a mailpiece; a transport mechanism that moves the mailpiece past the printhead during printing of the postage indicium; a postage meter including means for accounting for a value of postage associated with the postage indicium; an image generator in operative communication with the postage meter, the image generator producing a synchronous image data stream for use by the printhead in printing the postage indicium; a buffer which receives and stores the synchronous image data stream from the image generator; apparatus for switching the image generator between an ON status whereby the image generator produces the synchronous image data stream and an OFF status whereby the image generator does not produce the synchronous image data stream based upon the occurrence of a predetermined condition; structure for transferring the stored synchronous image data stream to the printhead in an asynchronous manner; and wherein the switching apparatus regulates within a predetermined range an amount of the synchronous image data stream stored in the buffer by switching the image generator between the ON status and the OFF status thereby effectively permitting the printhead to use the synchronous image data stream in an asynchronous manner.

11 Claims, 2 Drawing Sheets

APPARATUS AND METHOD FOR ENSURING GOOD PRINT QUALITY IN A MAIL HANDLING SYSTEM INCLUDING A FIXED PRINTHEAD/MOVING MAILPIECE SUBSYSTEM

BACKGROUND OF THE INVENTION

The invention relates to a mail handling system which prints information on a mailpiece, and more particularly to an apparatus and method for accurately controlling printing on a mailpiece in a mail handling system which transports mailpieces of varying size and weight at a high rate of speed.

Known postage meters are utilized in lieu of postage stamps as a means for printing an indication of paid postage (indicium) on a mailpiece. Additionally, mailing machines which perform some or all of the functions of transporting, separating, sealing, and weighing mailpieces at a high throughput are also known. When a mailing machine is combined with a postage meter so that the mailpieces being processed through the mailing machine have the indicium printed thereon, a mail handling system is created.

In recent years, the technological advancement in digital printing techniques has led to the use of digital printheads in postage meters as a preferred means for printing the indicium and other information on mailpieces. Digital printers, such as ink jet or laser printers, provide advantages over previously used rotary drum printing systems in that they are relatively inexpensive, easy to replace, and readily adaptable to print various images simply through the use of new or upgraded software. However, in a high speed mail handling system which, for example, can process 240 envelopes per minute, the control of the energizing of the digital printhead in synchronization with the movement of the mailpieces is essential for producing a good quality printed image at the required location on the mailpiece.

U.S. Pat. No. 5,561,103, issued to Arsenault et al., (hereinafter referred to as the '103 patent" and which is incorporated herein by reference), is directed to a low cost stand alone postage meter which incorporates an ink jet printhead and which is not connected to a mailing machine. In the '103 patent apparatus a user inserts a mailpiece into the postage meter and the mailpiece is then clamped in place. The inkjet printhead is then over the clamped mailpiece and prints the indicium on the mailpiece which is subsequently removed by the operator. In this apparatus, an Application Specific Integrated Circuit (ASIC) is utilized to draw indicium image data from a memory device and provides this image data to the printhead on an indicium image column by column basis in a synchronous manner. Since it is assumed that the printhead is being moved at a fairly constant velocity during printing and the image data is synchronously transmitted by the ASIC, the printhead fire pulse is fixed accordingly. Thus, in the '103 patent apparatus, as each column of image data is transmitted by the ASIC it is subsequently printed by the printhead before the next column of data is transmitted by the ASIC. This is referred to as real time column by column or draw on the fly printing whereby no more than one column of the image data is ever built and stored by the ASIC at one time.

It is quite clear from the above description of the '103 apparatus that since the ASIC transmits data synchronously in accordance with its own internal clock pulses, the energizing of the printhead to print each column of image data must occur within the pulse range of the ASIC for each block of column data in order to prevent corruption of the image data. In an ideal world, if the velocity of the printhead movement was controlled without variation, the firing pulse to the printhead could be fixed. However, there is some variation in the pulsing of the stepper motor which controls the printhead movement such that in the '103 apparatus means for adjusting the fire pulse rate to the printhead to accommodate such pulse variation is provided for as set forth in U.S. patent application Ser. No. 08/707,984 filed on Aug. 23, 1996. However, because the mailpiece medium is fixed and only the printhead is being moved, the variation in the velocity of the printhead is within plus or minus 3% of the ideal printhead velocity. This tolerance is small enough to be accommodated within the pulse width of the ASIC data transmission such that the minor adjustments to the printhead fire pulse do not create any data corruption.

A key benefit of using a fixed rate column by column image generator (ASIC) in the '103 apparatus is that the need for building, editing and storing the entire indicium image is not required such the throughput capability of the postage meter is increased. Moreover, since a dedicated RAM is not required to store the entire bit map image of the complete indicium, a reduced cost benefit is also achieved.

A known alternative to the digital image generating engine described above is set forth in U.S. Pat. No. 5,608,636. However, in the apparatus of the '636 patent a bit map of the entire indicium image for each individual postage transaction is first built and stored in a RAM prior to printing the indicium image on the mailpiece. Since the indicium image includes both fixed and variable data, a great deal of editing is required to build the entire image into the RAM on a mailpiece by mailpiece basis. This entire image building process takes time which either reduces the throughput of the printing process or requires the use of costly high-speed microprocessors to help improve printing throughput.

In view of the problems discussed above in connection with the apparatus of the '536 patent, the instant inventors desired to utilize an image generating engine similar to the one used in the '103 patent in a mail handling system capable of processing mixed size and weight mailpieces at high throughput speeds. Furthermore, since the ASIC described in the '103 patent was already implemented in the Personal Post Office™ postage meter product being sold by the employer, Pitney Bowes Inc., of the instant inventors, the reuse of the '103 ASIC was also desirable to reduce engineering development time, provide commonality between product lines, and achieve a reduction in product cost based on reduced costs realized by the ordering of larger quantities of a common component utilized in multiple products. However, the mail handling system that the inventors were concerned with was different from the stand alone postage meter of the '103 apparatus in that a stationary printhead was used to print the indicium on mailpieces being transported by the printhead at a high processing speed. Since the mailpieces being transported through the mail handling machine may vary significantly in weight, a variation in the rate at which the mailpieces will pass by the printhead can be as much as plus or minus 15% which is greater than the variation in the printhead speed of the apparatus of the '103 patent. Moreover, the encoder used in the mail handling system for synchronizing the energizing of the printhead with mailpiece movement is a quadrature output encoder where two output channels are utilized as a cost saving measure to provide the desired encoder count capability. Since two output channels are being used in this manner each output channel has an edge to edge tolerance such that the combined output encoder pulse edge to edge tolerance is approximately plus or minus 15% Accordingly, in the mail handling system that the inventors were concerned with a variation between encoder pulses could be as much as plus or minus 30% from the desired encoder pulse rate. Since the energizing of the printhead is directly associated with each encoder pulse, it became evident to the inventors that while the ASIC provided image data to the printhead at a fixed rate the use of the image data at the printhead was asynchronous due to the above discussed variation in encoder pulse frequency. However, unlike the apparatus of '103 patent, the 30% variation between encoder pulses could not be accommodated within the data producing pulse width of the image data generating ASIC. Thus, if the printhead utilizes the ASIC produced image data at a slower rate than it is generated by the ASIC the data becomes corrupted since the single column data buffer will be receiving the next column of data before the previous column of image data has been provided to the printhead. On the other hand, if due to the encoder tolerances the printhead utilizes the ASIC produced image data at a rate faster than the ASIC provides the image data, the image cannot be printed at the desired position or density required.

Thus, the instant inventors needed to invent an architecture which would permit the asynchronous use by a printhead of data produced synchronously by the prior art ASIC image generator.

SUMMARY OF THE INVENTION

It is an object of the invention to provide an apparatus which overcomes the disadvantages of the prior art as discussed above.

The above object is met by a mail handling system including a printhead for printing a postage indicium on a mailpiece; a transport mechanism that moves the mailpiece past the printhead during printing of the postage indicium; a postage meter including means for accounting for a value of postage associated with the postage indicium; an image generator in operative communication with the postage meter, the image generator producing a synchronous image data stream for use by the printhead in printing the postage indicium; a buffer which receives and stores the synchronous image data stream from the image generator; apparatus for switching the image generator between an ON status whereby the image generator produces the synchronous image data stream and an OFF status whereby the image generator does not produce the synchronous image data stream based upon the occurrence of a predetermined condition; structure for transferring the stored synchronous image data stream to the printhead in an asynchronous manner; and wherein the switching apparatus regulates within a predetermined range an amount of the synchronous image data stream stored in the buffer by switching the image generator between the ON status and the OFF status thereby effectively permitting the printhead to use the synchronous image data stream in an asynchronous manner.

Objects and advantages of the invention are set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DESCRIPTION OF THE PREFERRED EMBODIMENTS

Figure 1:
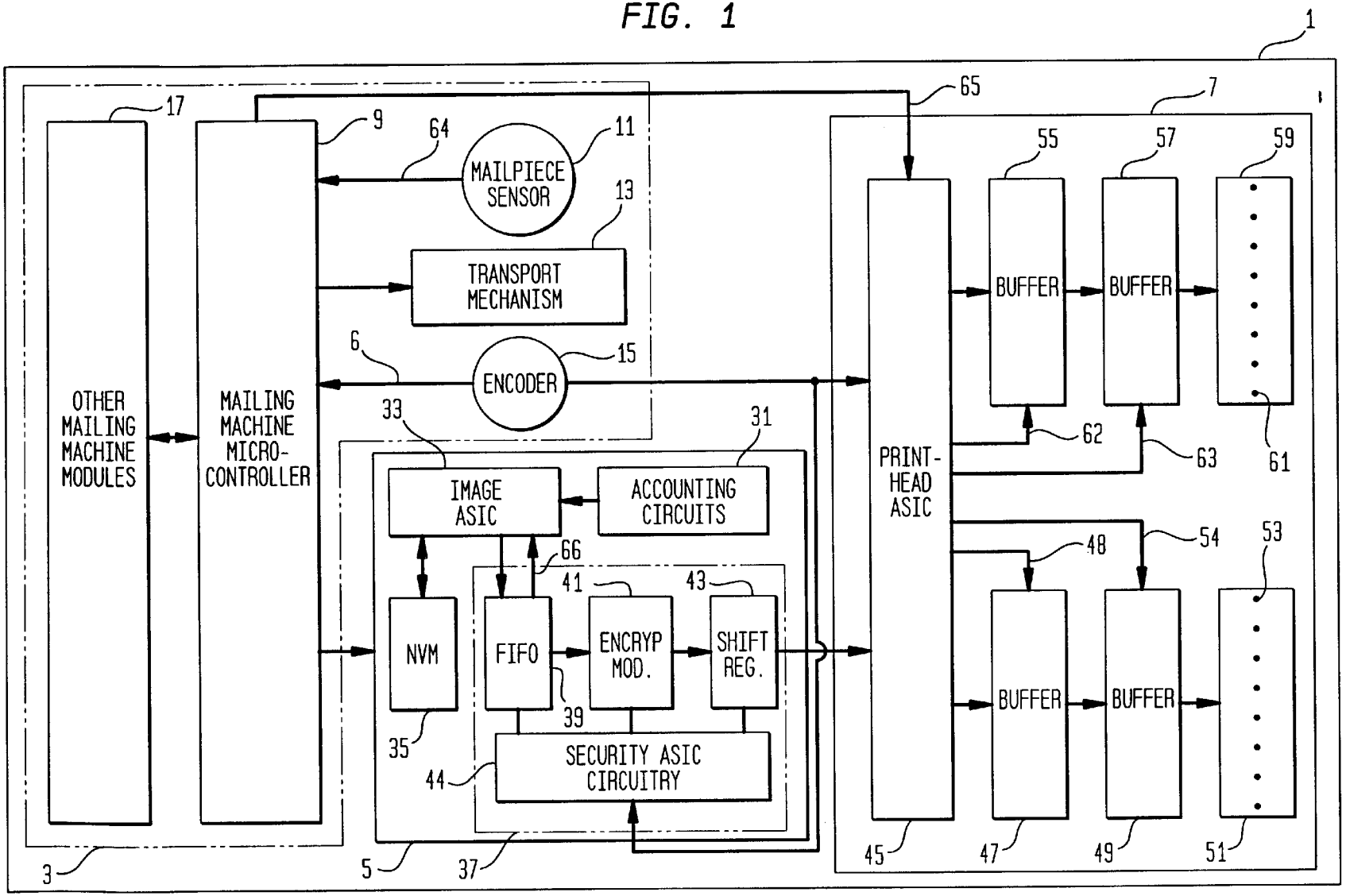
FIG. 1 is a schematic block diagram of a mail handling system incorporating the inventive image generating apparatus.

FIG. 1 shows a mail handling machine 1 including a mailing machine 3, a meter 5, and a printhead module 7. Mailing machine 3 includes a microcontroller 9, a mailpiece sensor 11, a mailpiece transport mechanism 13, an encoding mechanism 15, and other functional components which for the sake of simplicity have been grouped together and shown at 17. The grouped modules may include, for example, a sealing module, a front end feeder, a singulator and a weighing module all of which are in communication with and controlled by microcontroller 9.

Figure 2:
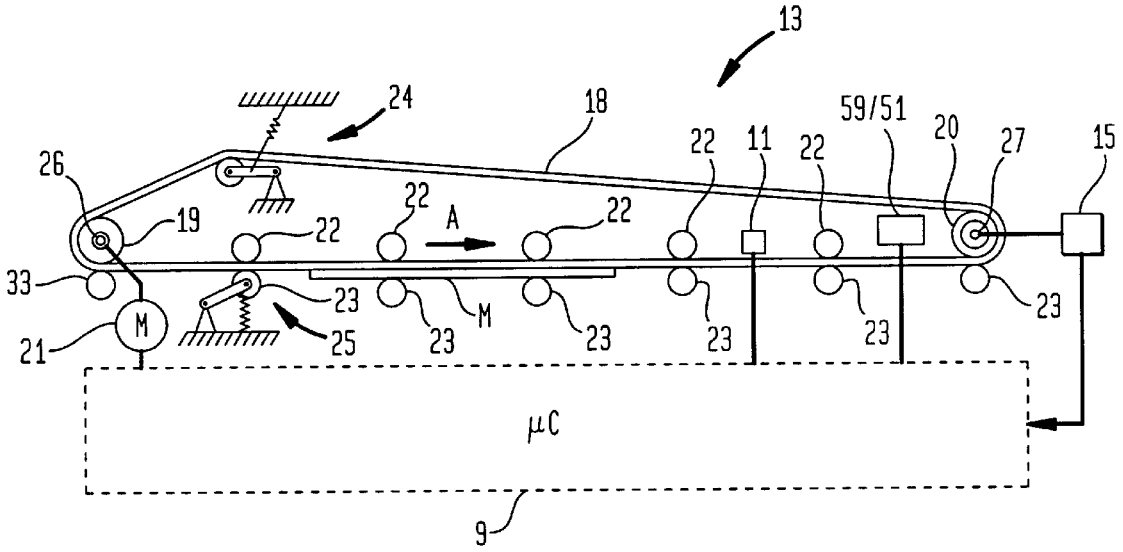
FIG. 2 is a schematic diagram of a transport mechanism used in the mail handling system of FIG. 1.

Referring to FIG. 2, transport mechanism 13 includes a continuous belt 18 driven around a drive pulley 19 and an encoder pulley 20 by a motor 21. Belt 18 cooperates with a series of idler pulleys 22 and normal pulleys 23 to move individual mailpieces "M" through the mail handling system 1. Additionally, a tensioning pulley assembly is generally shown at 24 to provide proper belt tension and each normal pulley 23 is biased toward the belt 18 by a biasing structure 25 (only one shown) to accommodate various thickness mailpieces which are being transported by transport mechanism 13. Motor 21 is connected by a conventional drive train to a shaft 26 around which drive pulley 19 is fixedly mounted and is controlled by microcontroller 9 to regulate the speed at which the individual mailpieces "M" are transported. The encoding mechanism 15 includes a conventional disk and optical detection device such as the respectively known Hewlett-Packard model numbers 5100 and 9100. Encoding mechanism 15 is operatively associated with a shaft 27 around which the encoder pulley 20 is fixedly mounted and provides signals to microcontroller 9 which signals are indicative of the velocity of the transported mailpieces "M". Thus, as the velocity of individual mailpieces "M" change such as, for example, when a light mailpiece is immediately followed by a heavy mailpiece, the change in velocity is calculated by microcontroller 9 based on the received encoder mechanism 15 pulses. The microcontroller 9 then controls motor 21 to compensate for mailpiece velocity variations to maintain as consistent a mailpiece "M" throughput as possible. This conventional closed loop motor control feedback system is known in the art and is more fully described in U.S. Pat. No. 5,740,728 and which is hereby incorporated by reference.

Referring back to FIG. 1, postage meter 5 includes conventional accounting circuitry 31 which keeps track of the amount of postage dispensed by postage meter 5 as well as the total amount of postage funds which have been added to postage meter 5 over its life. Additionally, postage meter 5 includes an image ASIC 33 which generates the image data utilized by the printhead module 7 to print the postage indicium image for the particular postage transaction requested. Image ASIC 33, which is also referred to herein as an image generating engine, obtains image data elements from a non-volatile (NVM) memory 35 and outputs this data in a synchronous data stream as set forth in the aforementioned U.S. Pat. No. 5,561,103. However, unlike the aforementioned patent, the synchronous data stream is not directly transmitted to a printhead module but is first sent to a security ASIC 37 within postage meter 5. The security ASIC 37 includes a First In First Out (FIFO) memory device 39, an encryption module 41, a shift register 43 and other control circuitry 44 for controlling operation of security ASIC 37. The image data stream of image ASIC 33 is first stored in FIFO 39 and is subsequently sent to encryption module 41, shift register 43 and printhead module 7. The encryption module 41 is utilized to encrypt the image data being transmitted between the postage meter 5 and the printhead module 7 to prevent it from being easily compromised.

In operation, for each individual mailpiece "M" being transported through the mail handling system bit map image data for the indicium image to be printed on that mailpiece "M" needs to be generated. Thus, for each mailpiece "M" the postage meter 5 receives a message from the microcontroller 9 that a postage indicium of a particular value needs to be printed on that mailpiece "M". Upon receipt of the message, the postage meter 5 accounts for the postage in accounting circuitry 31 and begins acquiring the necessary image data elements from the NVM 35 via the image ASIC 33. Image ASIC 33 sends the obtained image data in a serial and synchronous manner to FIFO 39 where it is buffered for subsequent use as described in more detail below. In the preferred embodiment, for each clock pulse of a clock (not shown) of image ASIC 33 eight blocks of data are sent with each data block containing 64 its of data. Upon receiving a command from control circuitry 44, each individual data block is then sent in a parallel manner to encryption module 41 where it is encrypted and subsequently sent to shift register 43. The block of data in shift register 43 is then sent to a printhead ASIC 45 where it is decrypted. The decrypted data block is then sent to a first printhead buffer 47 until it is latched, upon receipt of a latch signal 48 from printhead ASIC 45, into a second printhead buffer 49. The data in buffer 49 is finally sent to a first printhead 51 having nozzles 53 upon receipt of a fire pulse signal 54 from printhead ASIC 45 in order to energize the printhead nozzles 53 to print. Additionally, printhead module 7 further includes third and fourth printhead buffers 55, 57 which operatively interact with a second printhead 59 having printhead nozzles 61 based on latch signal 62 and fire pulse 63 in the same manner described above in connection with first printhead 51 and its associated buffers 47, 49.

In the embodiment set forth above, two printheads 51 and 59 are utilized to print the indicium. The printheads 51 and 59 are offset from each other in the direction of arrow "A" of FIG. 2 such that printhead 51 prints the bottom half of the image and printhead 59 prints the top half of the indicium image. Accordingly, the image generator 33 sequentially and synchronously sends out eight blocks of data with the first two data blocks (128 bits) being for the bottom half of the first column of image data and the second two data blocks being for the top half of the first column of the indicium image. Thus, as the printhead ASIC 45 receives the data stream from shift register 45, it provides the first two data blocks to the buffer 49 via the buffer 47 and the second two data blocks to buffer 57 via buffer 55. The next four data blocks are processed in the same manner until the buffers 55 and 47 are filled with image data for the second column of the indicium image to be printed. At this point in time, the printheads 51 and 59 are ready to be energized to print. The energizing of the printheads 51, 59 is directly related to the number of encoder pulses generated by the encoder mechanism 15. That is, when the lead edge of a mailpiece is sensed by sensor 11, it provides a signal 64 to microcontroller 9 which in turn sends a signal 65 to the printhead ASIC 45 indicative of the presence of the mailpiece "M". Upon receipt of the signal 65, the ASIC 45 counts a predetermined number of encoder pulses it receives from the encoder mechanism 15 to determine when to send the fire pulse signal 54 to energize the printhead 51 to print the bottom portion of the first column of the image. Then the printhead ASIC 45 sends the fire signal 63, in a time delayed manner relative to the fire signal 54 to account for the distance between the printheads 51 and 59, to energize the printhead 59 to print the top portion of the first column of the indicium image. Thus, when the top portion has been printed, a full column of the indicium image has been printed at the required position on the mailpiece "M" with the top and bottom portions properly aligned. After the initial fire pulse, the printheads 51 and 59 are energized for each encoder pulse to print the next column of data in the same manner as the first column was printed. Therefore, after the first fire pulses, the first and second latch signals 48 and 62 are respectively sent to the first buffers 47 and 55 to latch the image data stored therein into the corresponding buffers 49 and 57 in preparation of the energizing of the printheads 51 and 59 for printing the second column of image data. The buffers 47 and 55 are then ready to receive the next blocks of image data from the shift register 43 in timed sequence with the latching 48, and 62 and firing pulses 54, 63, based on receipt of the encoder pulses by the security ASIC 37. The timing of the processing of the blocks of data from the FIFO 39 to the encryption module 41 and the encryption module to the shift register 43 are all timed out based on the encoder pulse so that the exchange of data from the security ASIC 37 to the printheads 51 and 59 is accurately controlled.

As previously discussed, because of the variation between encoder pulses caused by mailpiece velocity variations and inherent encoder pulse tolerances, the transmission and use of image data from the FIFO 39 to the printheads 51 and 59 occurs asynchronously. However, the image ASIC 33 generates image data synchronously at eight blocks of data per image ASIC 33 clock pulse. In order to accommodate this inconsistency and to ensure that the required image data is available when needed by the printheads 51 and 59 and is not corrupted by being provided too quickly, the security ASIC 37 buffers the data in the FIFO 39 and turns the image generator 33 on and off as needed to ensure that the image data stored in the FIFO 39 remains within a predetermined range.

Figure 3:
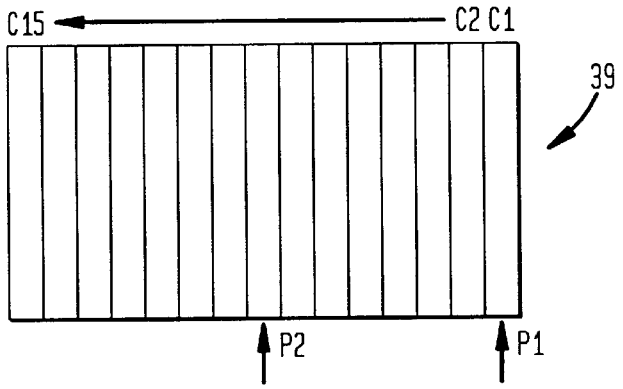
FIG. 3 is a schematic representation of a First In First Out memory device.

Referring to FIG. 3, an exploded view of the FIFO 39 is shown. FIFO 39 includes 15 individual registers C1–C15 which each can store one block (64 bits) of data. Additionally, a pair of pointers P1 and P2 is associated with the registers C1–C15. That is, pointer P1 identifies the next register C1–C15 whose block of data is to be sent to encryption module 41, while pointer P2 identifies the next register C1–C15 that will receive and store the next block of data coming from image ASIC 33. Thus, as a block of data is downloaded to the encryption module 41, the pointer P1 moves to the next sequential register C1–C15 whose data is next to be downloaded to encryption module 41. Moreover, as FIFO 39 receives a block of image data from image ASIC 33, pointer P2 moves to the next sequential register C1–C15 which is to receive and store the next block of image data from image ASIC 33.

Security ASIC 39 is also designed such that it sends an on/off signal 66 to image ASIC 33 which, depending on the on/off signal value (i.e. high or low), turns the image ASIC 33 on or off. Security ASIC 37 is designed such that as long as FIFO 39 has greater than or equal to 8 blocks of data (8 of registers C1–C15) stored therein a low signal is sent to image ASIC 33 turning the image ASIC 33 off such that it stops generating a synchronous image data stream. On the other hand, if FIFO 39 has less than eight blocks of data stored therein (eight of registers C1–C15) a high signal is sent to image ASIC 33 which causes image ASIC 33 to begin generating the synchronous image data stream continuing at the point from which it had previously been turned off. The determination as to the number of registers C1–C15 which have data therein is based on the positional difference between pointers P1 and P2.

As previously discussed, once the image ASIC 33 is turned on, it will generate at least eight blocks of data for each internal clock pulse. Thus, the regulated amount of buffered image data within the security ASIC 37 combined with its ability to "switch" the image ASIC 33 on and off ensures that 1) sufficient image data is made available to the printheads 51,59 at the desired asynchronous rate to permit accurate indicia printing and 2) the stored image data is not corrupted by the synchronous generation of image data by the image ASIC 33.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims.

What is claimed is:

1. A mail handling system comprising:

a printhead for printing a postage indicium on a mailpiece;

a transport mechanism that moves the mailpiece past the printhead during printing of the postage indicium;

a postage meter including means for accounting for a value of postage associated with the postage indicium;

an image generator in operative communication with the postage meter, the image generator producing a synchronous image data stream for use by the printhead in printing the postage indicium;

a buffer which receives and stores the synchronous image data stream from the image generator;

means for switching the image generator between an ON status whereby the image generator produces the synchronous image data stream and an OFF status whereby the image generator does not produce the synchronous image data stream based upon the occurrence of a predetermined condition;

means for transferring the stored synchronous image data stream to the printhead in an asynchronous manner; and wherein the switching means regulates within a predetermined range an amount of the synchronous image data stream stored in the buffer by switching the image generator between the ON status and the OFF status thereby effectively permitting the printhead to use the synchronous image data stream in an asynchronous manner.

2. A mail handling system as recited in claim 1, wherein the buffer is a FIFO memory.

3. A mail handling system as recited in claim 2, wherein the FIFO includes a plurality of registers for storing the synchronous image data stream and the predetermined condition is such that at times when the FIFO has less than a predetermined number of the plurality of registers containing some of the synchronous image data stream the switching means switches the image generator to the ON status and at times when the FIFO has greater than or equal to the predetermined number of the plurality of registers containing some of the synchronous image data stream the switching means switches the image generator to the OFF status.

4. A mail handling system as recited in claim 3, further comprising an encoder and wherein the printhead includes a controller for causing the printhead to print the postage indicium, the encoder is operatively connected to the transport mechanism to provide encoder pulses to the transferring means and the controller which are indicative of the velocity of the mailpiece being moved by the transport mechanism, and the transferring mechanism and the controller respectively utilize the encoder pulses to transfer the stored synchronous image data to the printhead and to cause the printhead to print the postage indicium in synchronization with the transfer of the stored image data to the printhead.

5. A mail handling system as recited in claim 4, wherein the plurality of registers are 15 registers and the predetermined number of the plurality of registers is 8.

6. A mail handling system as recited in claim 5, further comprising an encryption module which encrypts the synchronous image data prior to the transferring of the synchronous image data to the printhead.

7. A mail handling system as recited in claim 6, wherein the FIFO, the transferring means, the encryption module and the switching means are all part of a single security ASIC.

8. A mail handling system as recited in claim 7, wherein the image generator is an image ASIC.

9. A method for printing a postage image on a mailpiece in a mail handling system comprising the steps of:

moving a mailpiece past a printhead;

generating in a synchronous manner postage image data for each postage transaction utilizing an image generator;

buffering the postage image data generated by the image generator in a buffer;

sending the postage image data from the buffer in an asynchronous manner to the printhead;

utilizing the postage image data asynchronously at the printhead to print the postage image on the mailpiece in synchronization with the movement of the mailpiece past the printhead; and switching the image generator, based upon the occurrence of a predetermined condition, between an ON status whereby the image generator produces the postage image data synchronously and an OFF status whereby the image generator does not produce postage image data based thereby regulating within a predetermined range an amount of postage image data stored in the buffer to permit the printhead to print the postage image on the mailpiece by using the postage image data which is produced synchronously by the image generator in an asynchronous manner.

10. A method as recited in claim 9, wherein the buffer is a FIFO memory.

11. A method as recited in claim 10, wherein the FIFO memory includes a plurality of registers for storing the postage image data and the predetermined condition is such that at times when the FIFO memory has less than a predetermined number of the plurality of registers containing some of the postage image data the image generator is switched to the ON status and at times when the FIFO memory has greater than or equal to the predetermined number of the plurality of registers containing some of the postage image data the image generator is switched to the OFF status.

* * * * *